United States Patent [19]

Baker

[11] 4,305,558

[45] Dec. 15, 1981

[54] BAG CHECK OUT SYSTEM

[76] Inventor: Cal M. Baker, P.O. Box 367, Remington, Va. 22734

[21] Appl. No.: 52,330

[22] Filed: Jun. 26, 1979

[51] Int. Cl.[3] ..... B65B 67/04

[52] U.S. Cl. ..... 248/100; 53/390

[58] Field of Search ..... 248/95, 97, 99, 100, 248/101; 53/390; 141/316, 390; 232/43.1, 43.2; 220/404

[56] References Cited

U.S. PATENT DOCUMENTS

| | | | |
|---|---|---|---|
| 830,994 | 9/1906 | Hatin | 248/100 X |
| 999,910 | 8/1911 | Thompson | 248/100 |
| 1,005,956 | 10/1911 | Gibbins | 248/100 X |
| 3,557,907 | 1/1971 | Close | 53/390 UX |
| 3,747,298 | 7/1973 | Lieberman | 248/100 X |
| 4,106,734 | 8/1978 | Walitalo | 248/100 |

FOREIGN PATENT DOCUMENTS

| | | | |
|---|---|---|---|
| 83858 | 11/1957 | Denmark | 248/97 |
| 102502 | 8/1965 | Denmark | 248/100 |
| 1085807 | 7/1960 | Fed. Rep. of Germany | 53/390 |
| 2002732 | 8/1970 | Fed. Rep. of Germany | 248/100 |
| 262871 | 5/1964 | Netherlands | 248/100 |
| 120020 | 10/1970 | Norway | 248/100 |

*Primary Examiner*—J. Franklin Foss
*Attorney, Agent, or Firm*—Fred Philpitt

[57] ABSTRACT

An improved system for supporting a bundle of bags for easy access and loading adjacent the checkout area of a store which includes a first support member adapted to support a bundle of bags that is composed of an elongated substantially horizontally disposed member mounted beneath the countertop of a checkout area so that a substantial portion of said bundle of bags can be out of view beneath the countertop, a second support member adapted to support one handle of a bag, said first and second support members being mounted at a spaced distance apart from each other adjacent the checkout area, which distance generally corresponds to the width of a bag in its open position, the inner ends of said support members having enlarged configurations which serve to hold the opposite handle portions of a bag so that the bag will remain in an open position during a loading operation.

1 Claim, 4 Drawing Figures

BAG CHECK OUT SYSTEM

SUMMARY OF THE INVENTION

A system for supporting bags for easy access and loading adjacent a checkout area which includes an elongated support member mounted beneath the countertop so that many of the bags can be out of view beneath the countertop, a second member adapted to support one handle of a bag, said first and second members being mounted at a spaced distance apart that generally corresponds to the width of a bag in its open position, the inner ends of said support members having enlarged configurations which serve to hold the opposite handle portions of a bag so that the bag will remain in an open position during a loading operation.

The invention is best understood by reference to the attached drawings wherein

Figure 1:
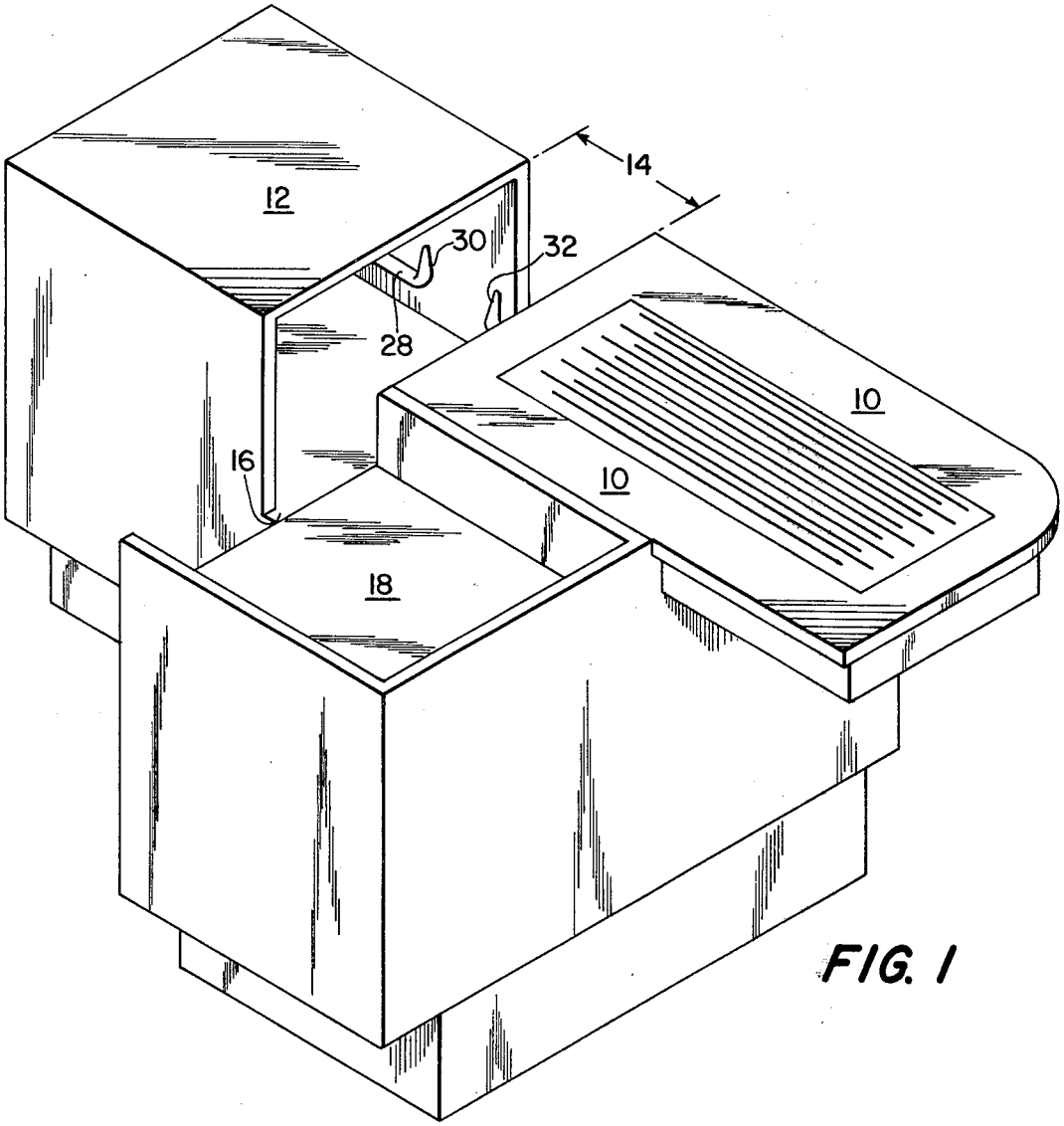
FIG. 1 is one perspective view of the invention.

Referring now to the drawings, FIG. 1 illustrates a check out arrangement for a store in accordance with this invention.

Figure 2:
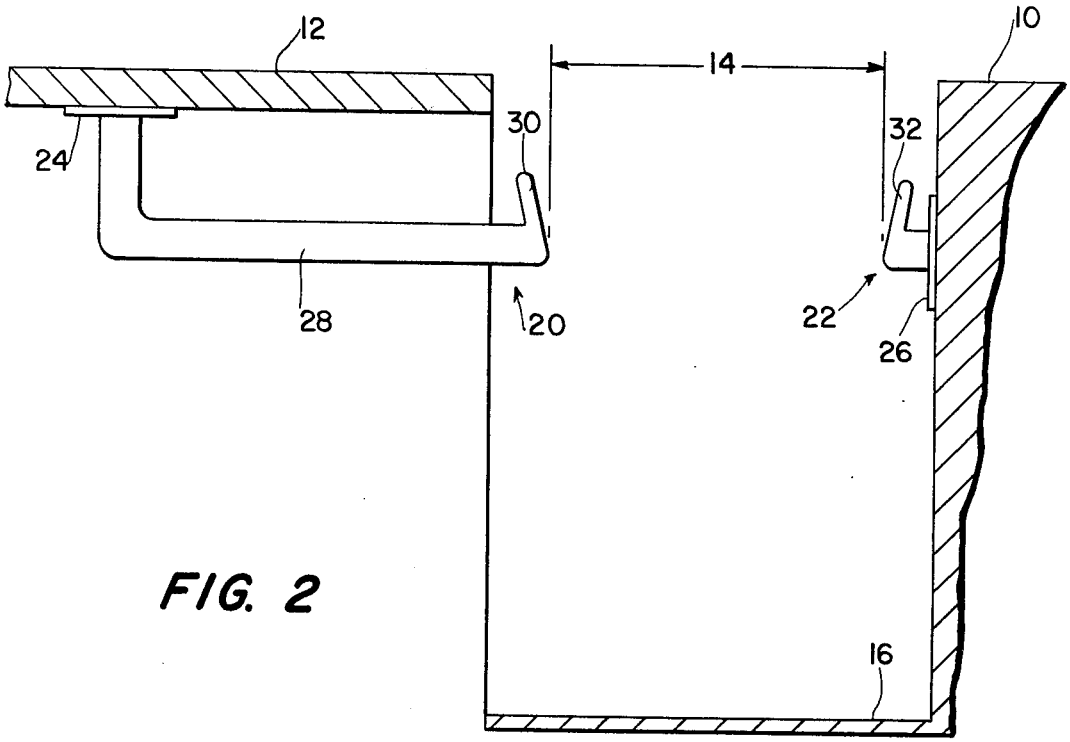
FIG. 2 is a fragmentary section view of the support system.

Counter tops 10 and 12 are spaced apart from each other by a distance of about 10–20 inches, which is indicated by the arrows 14. As is best shown in FIG. 2 a shelf 16 extends between the counters at some point below (e.g. 14–17 inches below) the upper surfaces of the counters 10 and 12. The shelf 16 may be constructed so that it is vertically adjustable or the shelf 16 may be permanently fixed in position. A side support surface 18 is provided for a cash register.

The underside of countertop 12 is provided with a bag support member 20 and the countertop 10 is also provided with a bag support member 22. The means for mounting the hook support 20 can be a mounting plate 24 that can be screwed into the underside of the countertop 12. The means for mounting the support 20 can be a mounting plate 26. The support 20 is seen to include an elongated rod portion 28 which has one end connected to the mounting plate 24 and which has the other end terminating in an upstanding stop member 30. The support 22 is similar except that the stop member 32 is connected to the mounting plate 26 by a much shorter section than elongated rod portion 28.

Figure 3:
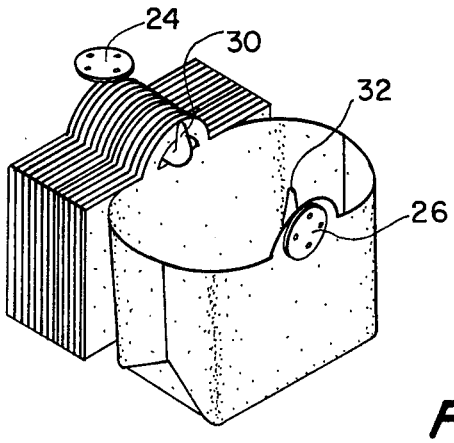
FIG. 3 is a perspective view of bags and bag supports.

Support 20 is adapted to support a bundle of bags by extending through opposed handle openings on each bag. The bags can be of the type set forth in U.S. Pat. No. 3,967,775. As can best be seen from FIG. 2, when a bundle of bags is placed on support member 28 most of the bags will be beneath the countertop 12 and none or only a relatively few bags will extend out into the space 14. When a store customer is ready to leave a store he removes the items he has purchased from his shopping basket and places them on the countertop 10. The checker then moves the outermost bag of the bundle over the stop member 30, thus pulling the bag into an "open" position, and while in this open position engages the removed handle over stop member 32 so that the bag will remain supported in an "open" position between stop members 30 and 32. The checker can then load the items into the open bag as the cost of each item it rung up on the cash register. The bottom of the open bag is preferably supported by either a stationary support shelf 16 or by a support shelf that can be raised and lowered to provide the desired support. FIG. 3 shows how the support members are designed to hold both a bundle of bags and one open bag.

When a bag has been filled in this manner either the checker or the customer can remove the handles from the stop members 30 and 32 and the customer can then lift and carry away the filled bag. The checker then again moves the next bag in the bundle over the stop member 30, pulls the bag into an open position and engages the removed handle over stop member 32 so that this next bag is ready for filling for the next customer.

Figure 4:
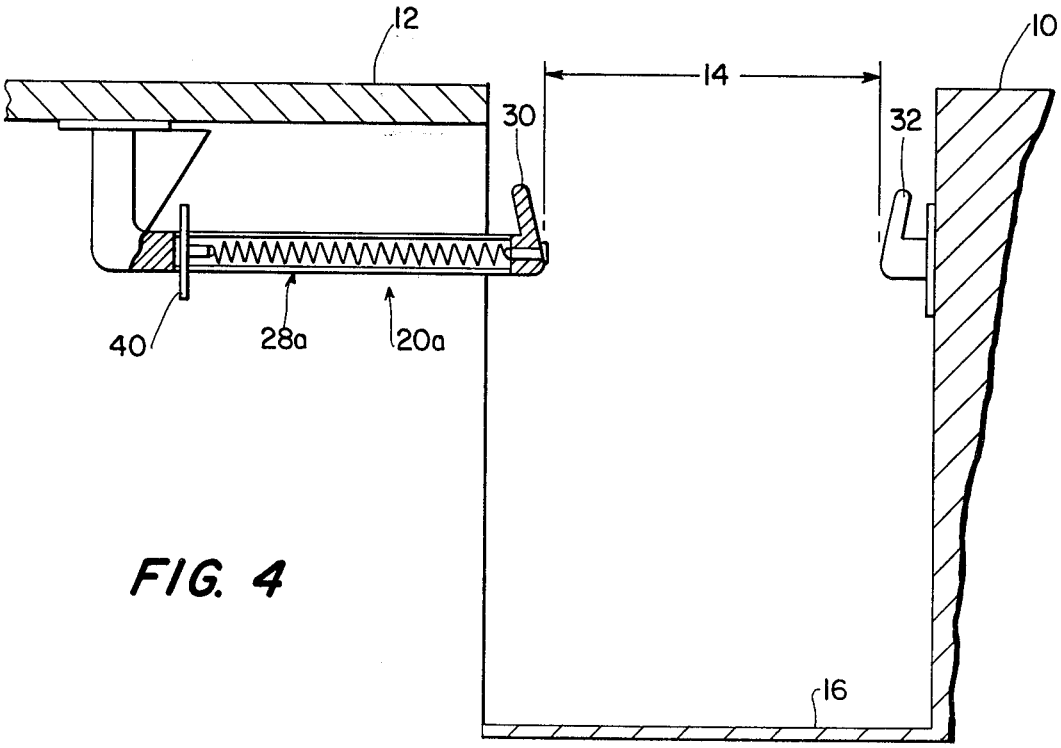
FIG. 4 is a fragmentary section view showing specific features of the invention.

FIG. 4 illustrates an embodiment wherein the hook support **20*a* includes a means to urge the bundle of bags outwardly as the supply is used up. This means includes a spring loaded member 40 that is urged to the left against the spring action when the bundle of bags is initially placed on the support member 28*a* and as the bags are sequentially removed by the checker the bundle of bags is urged to the right by member 40**. This insures that the bags will always be positioned most conveniently for the checker.

I claim:

1. An improved system for supporting a bundle of bags for easy access and loading adjacent the checkout area of a store which includes (1) a first support member adapted to support a bundle of bags, said first support member being composed of an elongated substantially horizontally disposed member that is mounted beneath the countertop of a checkout area so that a substantial portion of said bundle of bags can be out of view beneath the countertop.

(2) a second support member adapted to support one handle of a bag, (3) said first and second support members being mounted at a spaced distance apart from each other adjacent the checkout area, said spaced apart distance generally corresponding to the width of a bag in its open position, (4) the inner ends of said support members having enlarged configurations which serve to hold the opposite handle portions of a bag so that the bag will remain in an open position during a loading operation.

* * * * *